US007121044B2

(12) United States Patent
Santaolalla Gil et al.

(10) Patent No.: US 7,121,044 B2
(45) Date of Patent: Oct. 17, 2006

(54) LIGHT WINDOW LIFTER FOR VEHICLES

(75) Inventors: Joaquin Santaolalla Gil, Burgos (ES); Francisco-Javier Martinez Moral, Burgos (ES)

(73) Assignee: Grupo Antolin-Ingenieria, S.A. (ES)

( * ) Notice: Subject to any disclaimer, the term of this patent is extended or adjusted under 35 U.S.C. 154(b) by 63 days.

(21) Appl. No.: 10/482,497

(22) PCT Filed: Apr. 3, 2002

(86) PCT No.: PCT/ES02/00164

§ 371 (c)(1),
(2), (4) Date: Dec. 31, 2003

(87) PCT Pub. No.: WO03/083240

PCT Pub. Date: Oct. 9, 2003

(65) Prior Publication Data

US 2004/0187389 A1 Sep. 30, 2004

(51) Int. Cl.
*E05F 11/48* (2006.01)

(52) U.S. Cl. ..... 49/352

(58) Field of Classification Search ..... 49/348, 49/349, 352, 501

See application file for complete search history.

(56) References Cited

U.S. PATENT DOCUMENTS 5,407,994 A * 4/1995 Sarabi et al. ..... 524/539
5,461,830 A 10/1995 Dupuy
5,924,245 A 7/1999 Manuel et al.
6,052,947 A * 4/2000 Smith ..... 49/352
6,430,873 B1 * 8/2002 Borchuk et al. ..... 49/352
6,431,490 B1 * 8/2002 Monget et al. ..... 242/444
6,758,013 B1 * 7/2004 Staser et al. ..... 49/352
2002/0049295 A1 * 4/2002 Pertusio et al. ..... 528/10
2004/0036658 A1 * 2/2004 Schlieber et al. ..... 343/713
2005/0107545 A1 * 5/2005 Bormann et al. ..... 525/327.4

FOREIGN PATENT DOCUMENTS

DE 19705054 A1 8/1998
DE 19821075 A1 11/1999
EP 0653538 A2 5/1995

* cited by examiner

*Primary Examiner*—Jerry Redman
(74) *Attorney, Agent, or Firm*—Ostrolenk, Faber, Gerb & Soffen, LLP

(57) ABSTRACT

This window regulator is constituted by a rail which is obtained in a single piece, by injection of a light-weight metallic alloy, integrating a great many of the window regulator components, like for example: the supports (1) for fastening the window regulator to the door of the vehicle, the support (2) and anchoring elements (6) for the drive motor used in the systems of electric window regulators, the coupling elements (5) of the Bowden system for tensioning the cable (4), necessary in the manually operated systems, the housing (8) for the cable-winding drum, the sliding or diverting elements (3) of the cable (4). Moreover, the rail leaves the mould, with an appropriate curvature for correctly following the window. glass, even though the latter has a very complex shape. Thus, the same rail can be used indistinctly for manual window regulators, electric window regulators and dual rail window regulators.

4 Claims, 4 Drawing Sheets

LIGHT WINDOW LIFTER FOR VEHICLES

OBJECT OF THE INVENTION

The present invention relates to a window regulator for vehicles, in which the rail on which the carriage which transports the window slides has been obtained by injection of alloyed metals and can be used indistinctly for manually operated window regulators, electrically operated window regulators and even dual rail window regulators.

The aforesaid rail incorporates, in the actual injection process, a great number of pieces of the window regulator, which reduces the assembly time of the device, also integrating the supports for securing to the door which allow the fastening of the window regulator to be carried out directly, with no necessity to use inserts or additional reinforcements.

Also, through being obtained by injection, the rail can be obtained from the mould with a certain curvature which allows the carriage to follow the movement of the window although the latter has a very complex shape.

BACKGROUND OF THE INVENTION

At the present time, the window regulator systems for vehicles can be divided into three large groups:

Cable window regulators which can be single rail and dual rail.

Cord-drawn window regulators.

Single- or double-arm window regulators.

The present invention relates to window regulators of the cable type, for which reason hereinafter reference will only be made to this window regulator system.

The cable window regulator systems employed habitually, are constituted by a metallic rail on which a carriage slides which is joined to or simply pushes the window of the vehicle. The sliding of the carriage, in one direction or the other, causes the window to move upwards or downwards.

For the displacement of the carriage a cable is used which, passing through some pulley wheels mounted on the ends of the rail, is extended to the position that is occupied by the drive mechanism by means of the corresponding crank or to the electric drive motor.

In the case of manual operation, the cable is tensioned in a permanent way by means of a device termed "Bowden" which is arranged surrounding the cable, between the rail and the drum casing on which the operating crank is mounted.

In the systems of window regulators employed habitually, the rail is constituted by a metallic section obtained by cold forming, usually stamping or rolling, on which are mounted, to a great extent in a manual way, the remaining components, that is, the pulley wheels which facilitate the sliding of the traction cable, the coupling supports for the Bowden system, the elements for guiding the cable, as well as the supporting elements for the motor, when the driving action is electric. These assembly operations increase the end product cost considerably, and also involve greater complexity in operations of storage and administration of the various elements, and they imply a failure hazard both in manipulation during the assembly operations and during the working life of the product.

Also, to fasten the window regulators to the door of the vehicle, some supports are used which are joined, generally by welding, to the rail of the window regulators and through which the assembly is screwed to the door.

So, the assembly of the window regulators implies the screwing and welding of pieces of different materials and characteristics, which complicates the assembly operations of the system in the automobile.

Moreover, the geometries of vehicle windows are increasingly complicated, in such a way that the rail has to have an appropriate geometry so that the carriage can follow the movement of the window which, with the complex forms presently used, is not a straight-line movement within a same plane but rather it is approximately a helical movement.

For this reason, the rail ought to have a slight curvature but, by being constituted by a stamped metallic section, it proves very difficult to manage that the latter has the curvature with a precise permanent deformation since, these slight deformations are elastic and the section tends to recover its initial form, once the process of shaping the same has concluded. For this purpose, the rail of the window regulators is mounted on the door in a forced manner to compel it to remain bent and acquire the desired degree of curvature, which operation has to be carried out by a specialized worker since the manner of fastening the rail on the door is that which has to produce the twisting of the rail and, in consequence, the required curvature so that the carriage can follow the movement which the window glass requires.

In an attempt to resolve this problem, in the patent PCT ES99/00246 of the same applicant, a system is disclosed in which the rail of the window regulator is obtained by injection of plastic, being integrated in the rail itself some of the elements, like for example, the elements for rerouting the cable or the supports for securing to the door of the vehicle. In this patent, a casing which houses the motor is also implemented in plastic and which is mounted on the rail, by means of a system of pre-tensioning the drive cable.

In this patent the assembly operations are decreased in part and even, by being constituted in plastic but, it continues presenting a series of drawbacks like for example the following:

It is necessary to mount some metallic inserts to perform the fastening of the rail to the door of the vehicle since the securing screws cannot be threaded directly into a plastic element.

Due to the poor rigidity of the plastic, designs are required with a large surface and generally provided with a large number of stiffening ribs which implies a machine for injection of greater capacity and complexity and a large consumption of plastic.

This also implies that the space occupied by the rail produces interference with other components of the door and with those of the window regulator itself, like the cable, resulting in problems of assembly, noise, added friction and wear, lack of accessibility, etc.

The mechanical properties of the plastic are greatly influenced by the temperature, for which it can suffer deformations that shorten its useful life.

It is mentioned that any one of the systems habitually employed, both with a metallic rail or a plastic rail have the drawback that they are made specially adapted to their utility, that is, by varying the number and typology of the pieces to be mounted it is possible to produce a different rail if the window regulator is manual or electric and also if the window regulator is single or dual rail, as a function of the different versions to be manufactured, for which reason different references must be handled which increase costs and warehouse requirements.

DESCRIPTION OF THE INVENTION

The window regulator object of the invention, is constituted by a rail which is obtained by injection of a metallic alloy, adapting the design of the same to said injection process while achieving the advantages and functions herein described, which permits most of the elements of the window regulator system to be integrated in the actual rail, having also a very stylised profile but which maintains the required properties of strength, in such a way that a small amount of alloy is required for the obtaining thereof and, therefore, it is of reduced cost.

This implies that it is possible to incorporate all the elements which can be necessary, be it for a manual or electric window regulator or for a single rail or dual rail system, whereby for all these possibilities the same rail will be used since the cost increment implied by the incorporation of elements which will not be used in some cases, it is perfectly acceptable, being only the cost of the added material, which does not happen when passing from one version to another of window regulator signifies incorporating more pieces and their corresponding assembly operations.

Thus, there will be a single rail reference which can be used indistinctly for all cases, that is, manual window regulator, single rail or dual rail, or electric window regulator.

Also, by being obtained by injection, the rail on which the carriage which moves the window slides, leaves the mould with the precise curvature necessary for the carriage to be able to follow the movement of the window glass, even though this has a very complex shape.

In brief, the rail of the invention incorporates in the actual moulding operation the following elements:

The support and anchoring elements for the drive motor.

The supports for coupling the Bowden cable-tensioning system.

The housing for the cable-winding drum.

The elements over which the cables slide or are diverted.

The supports for fastening the window regulator to the door of the vehicle.

With this configuration, for the assembly of the window regulator system, it is only necessary to mount the cable, together with the carriage previously mounted thereon, and the winding drum on the rail and, if the operation is manual, to couple the Bowden system. In the case of an electric window regulator, the Bowden system is not necessary but the pertinent drive motor has to be mounted which will be coupled on the winding drum and fastened directly to the rail, by means of screws or the like.

Thereafter, the already-mounted assembly is screwed directly on the door of the vehicle with no need to use supports or metallic inserts to obtain a sufficiently strong fastening.

Also, in comparison with plastic rail solutions like those described previously, this system offers the advantage that by being constituted by a very light structure, it leaves enough free space for the drive cables to run in free suspension over practically the entire course, thereby eliminating the friction between the latter and the rail. In the plastic rail it is not possible to reduce the dimensions so that the cable runs in free suspension since in that case a greater cross section is needed to give the rail enough rigidity to support the forces to which it is subjected, especially at the end of the upward and downward travel of the window glass, during its movement.

This reduction of the friction between the cable and the rail allows for example the use of electric motors of less power consumption, in the case of electric window regulators, a more uniform upward and downward motion of the window being also obtained.

Nevertheless, there are three points of contact between the cable and the rail, namely the channels for diverting the cable and the joining area of the motor support, so that the friction and wear which the drive cable produces is concentrated in these points.

To increase the resistance to wear of the rail, the possibility exists of using a specific de-moulding agent in the mould, which is characterised in that it is composed by waxes of vegetable or animal oils and Teflon, which forms a permanent surface layer on the injection piece which, besides facilitating the de-moulding of the piece, reduces the friction between the cable and the points of contact of the rail, as well as the wear of both during the entire useful lifetime of the rail, supporting the habitual environmental conditions in the automobile.

If it were necessary to achieve greater strength in the areas of contact with the cable, the possibility has been foreseen of incorporating some elements, generally of plastic material, by way of sliding tracks for the cable and, specifically, some clips of plastic or metallic material provided with some flexible pinions or pins below which will engage in some holes arranged for this purpose in the rail.

Depending on the model and the properties required of the rail, it can have different added elements or not.

The rail object of the invention therefore has the following advantages over the previous systems:

Reduction of the projected surface of the rail, which implies the use of injection machines of lower capacity and also the reduction of the cycle times necessary for its production.

Significant reduction in the weight of the window regulator.

The rail is universal since it serves for manually or electrically operated window regulators, as well as for window regulators of the single or dual rail type, simplifying all the possible versions into a single reference.

Integration of several window regulator elements, this being obtained in the actual moulding operation, eliminating in this way a good number of different references of pieces, as well as the corresponding operations of assembling and joining these elements.

By having a stylised profile, the cable runs in free suspension, decreasing the friction between the two elements, which allows for example the use of electric motors of less consumption.

The rail is directly recyclable since it is obtained from a single material.

PREFERRED EMBODIMENT OF THE INVENTION

Figure 1:
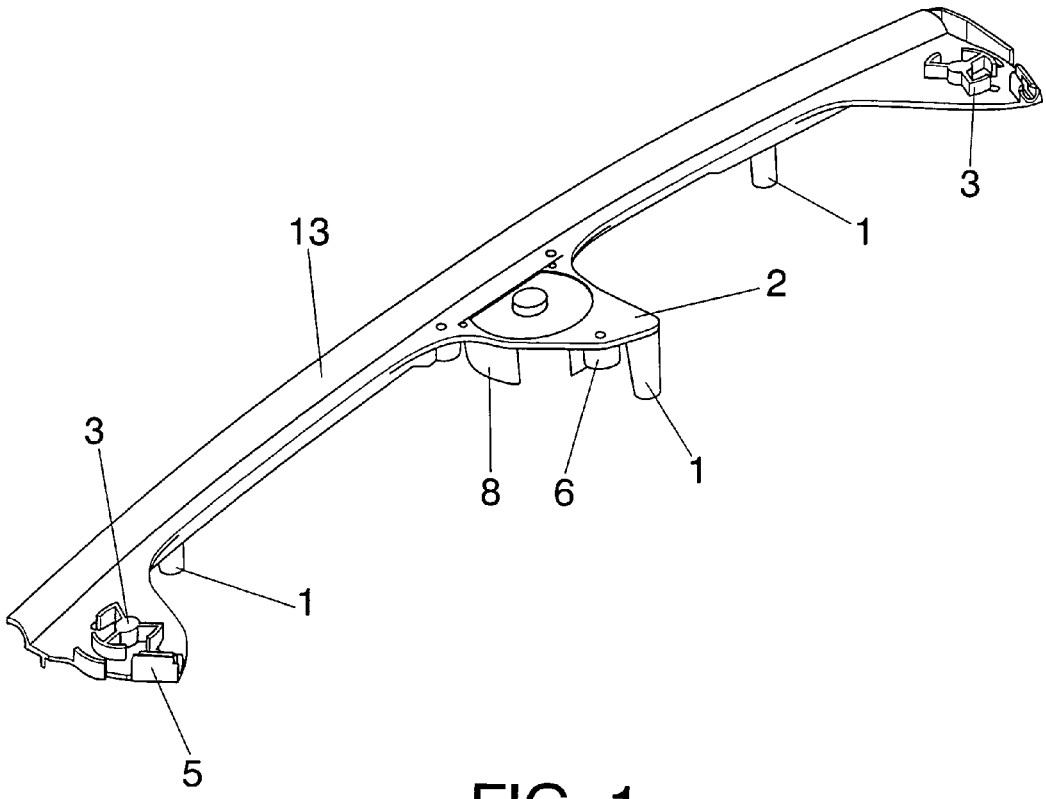
FIG. 1.—It shows a perspective of the rail of the invention.

As is observed in FIG. 1, the rail object of the invention is constituted by a stylised structure, obtained by injection of a metallic alloy which incorporates the slipway (13) of the carriage (14), the supports (1) for fastening to the structure of the door, the support (2) for holding the drive motor, the means (3) of diverting the cable (4) and the coupling elements (5) for the Bowden system for tensioning the cable and guidance thereof.

Figure 2:
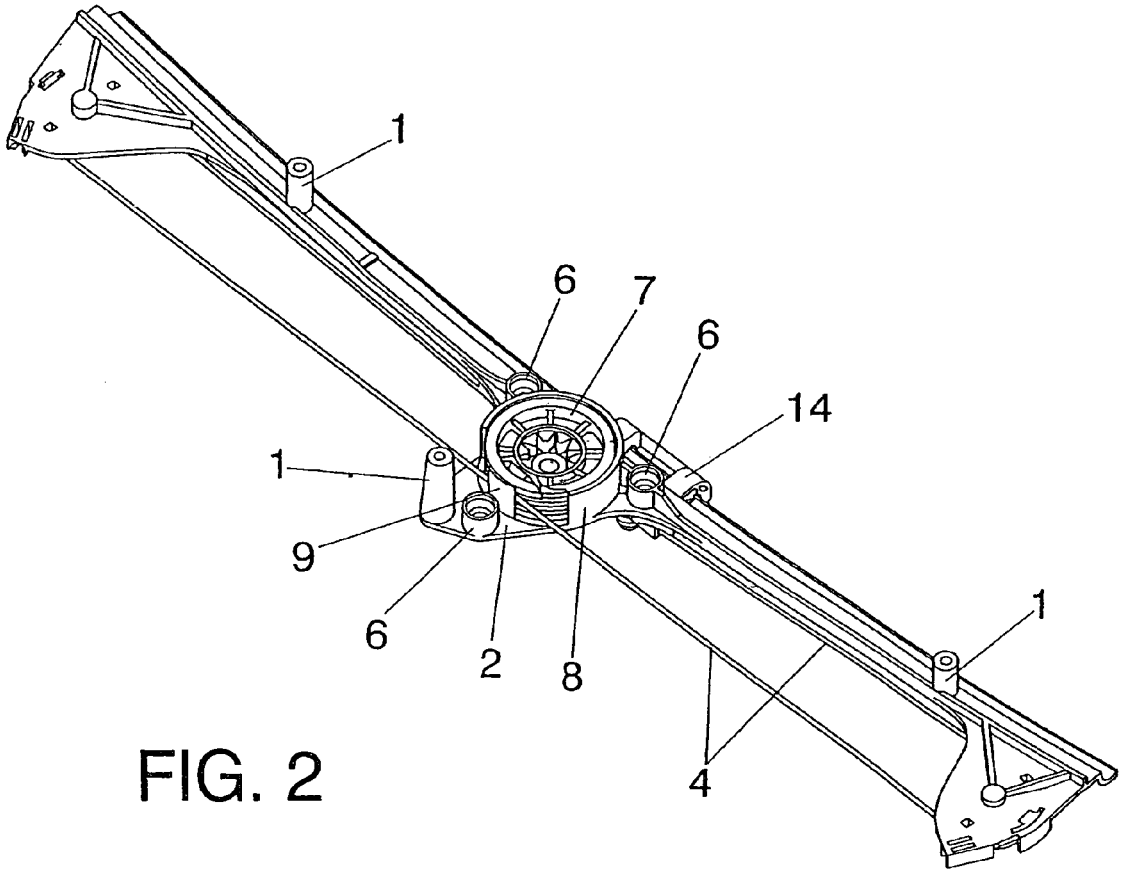
FIG. 2.—It shows a perspective of the window regulator of the invention, incorporating all the elements which have to be mounted on the rail, like the drive cable, the cable-winding drum and the carriage.

As is observed clearly in FIG. 2, the supports (1) are constituted by some projecting pivots, traversed by a threaded hole, so that the rail can be fastened to the door, directly by means of screws, with no need for using inserts or metallic reinforcements.

The support (2) for securing the motor incorporates some projections (6) by way of supports integrated in said support, usually three projections, each of them with its corresponding threaded hole, and to which the aforesaid motor is screwed directly, in the case of operation being electrical. When operation is manual, these projections (6) are unused.

On the support of the motor the cable-winding drum (7) is also mounted, this support having for this a partition (8), approximately cylindrical, which maintains the aforesaid drum (7) in position. It also incorporates a vertical web (9), in the exit area of the cable (4), which prevents the cable becoming loose and possibly coming off the drum.

Figure 3:
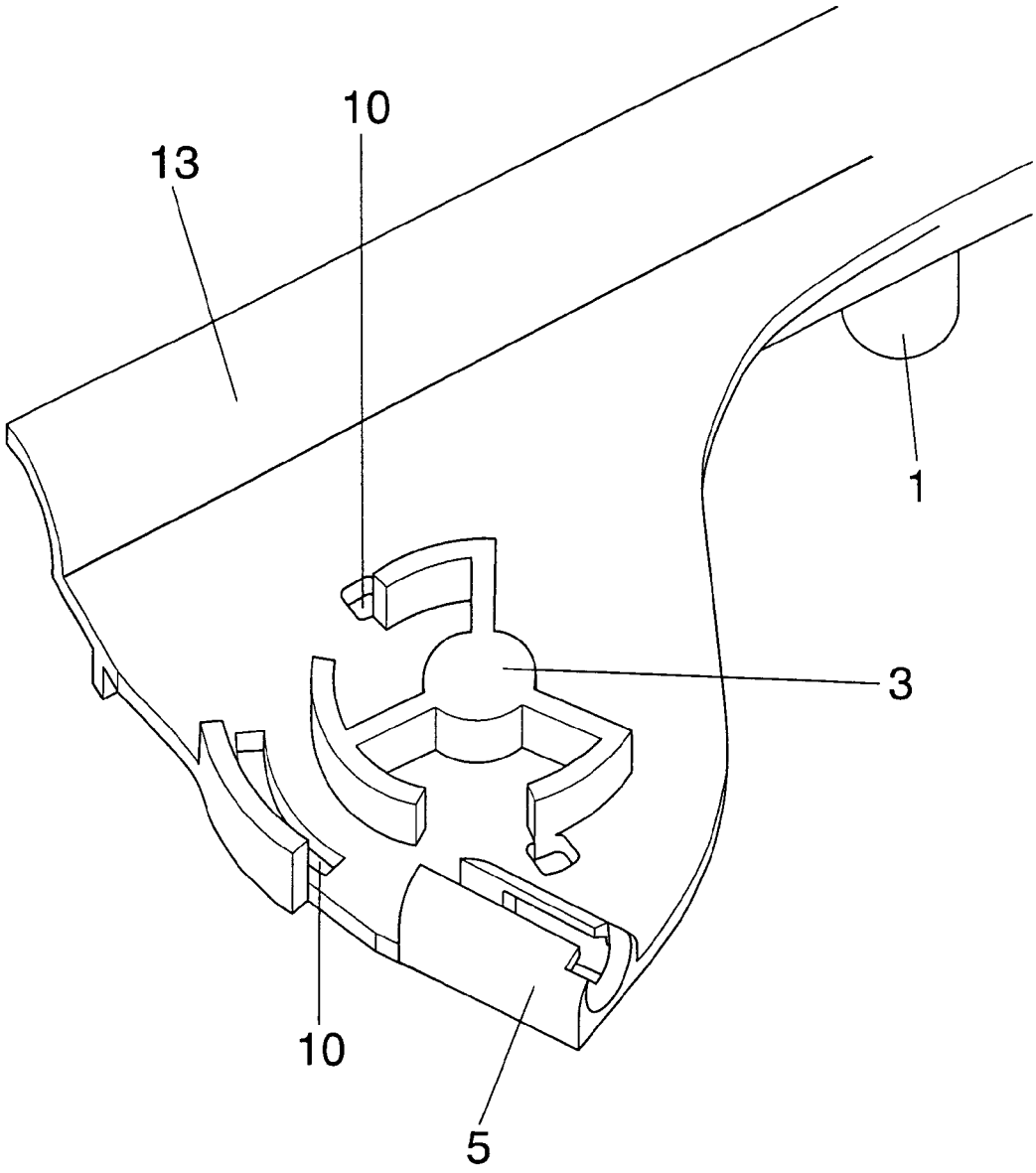
FIG. 3.—It shows an enlarged detail of one of the ends of the rail wherein one can see the device for diverting the cable, the support for coupling the Bowden system and the holes foreseen for the optional incorporation of some plastic clips highly resistant to wear.

In FIG. 3 can be seen, as well as the elements for diverting the cable and the coupling for the Bowden, the holes (10) foreseen to couple, optionally, strengthening pieces in the areas of contact between the cable and the rail.

Figure 5:
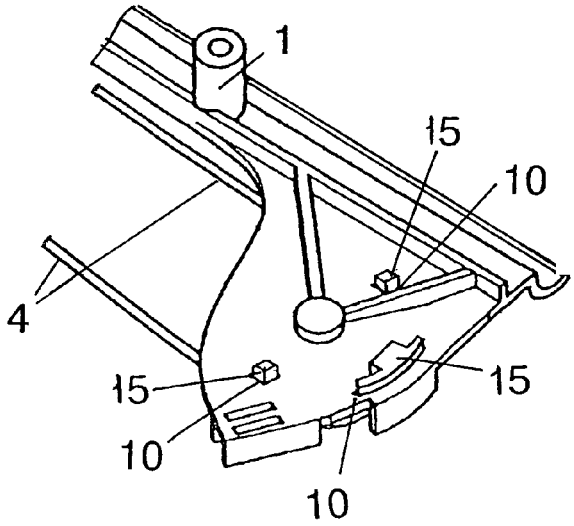
FIG. 5.—It shows an enlarged detail of one of the ends of the rail of FIG. 4 as seen from an opposing view, FIG. 5 further showing the connection of a plastic clip to the rail.
Figure 4:
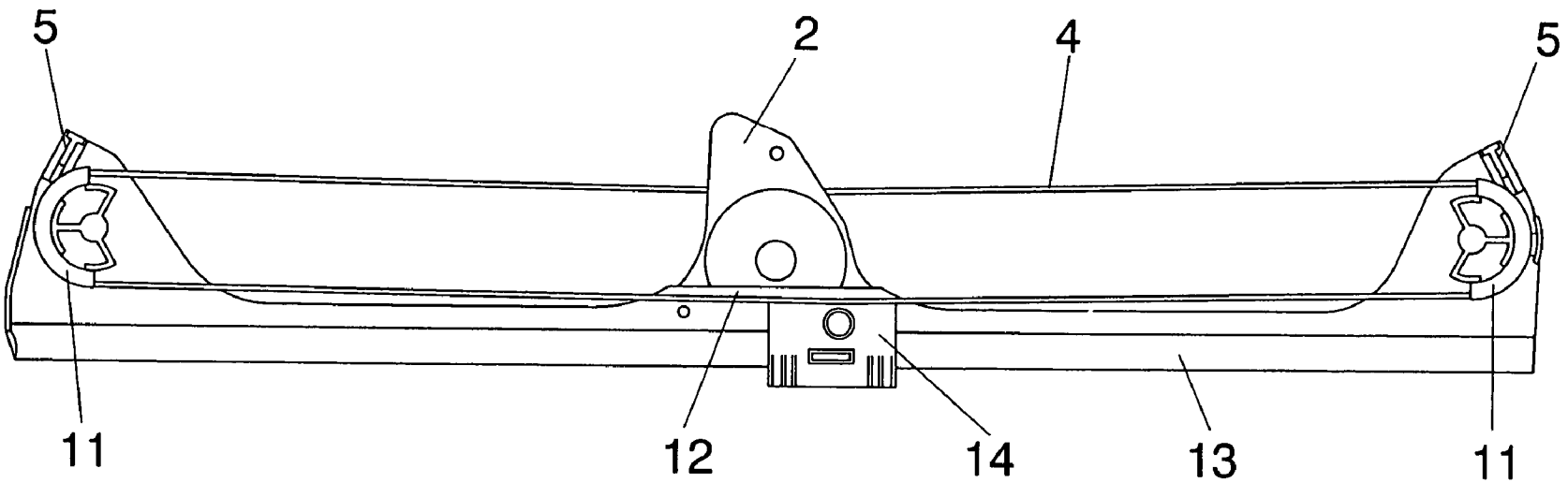
FIG. 4.—It shows a plan view of the rail of the invention, with all the elements mounted and incorporating the plastic clips for reinforcement in the three areas of contact between the cable and the rail.

In FIG. 4 it is clearly seen how the cable slides, in free suspension, over practically all its course, there being only three contact points with the rail and, specifically, the two areas of diversion of the cable and the central area, in correspondence with the support for the motor. In this figure some strengthening clips (11) and (12) have been shown, of plastic material, which would be mounted in those three areas, when the wear produced by the cable can be excessive. Specifically, two semi-cylindrical plastic clips (11) are used which carry out the function of diverting the cable (4) and a central clip (12) which has a longitudinal groove which guides the cable, it having been foreseen that the clips (11) and (12) incorporate some pinions or pins (15) (as shown for a clip (11) in FIG. 5) below for rapid engagement in the holes (10) foreseen for this purpose in those areas of the rail.

The rail object of the invention, through being constituted by a metal alloy obtained by injection, preferably aluminium or magnesium alloys, is very strong, with very stylised dimensions, so that it signifies a small consumption of metal alloy and therefore it is possible to incorporate all the elements mentioned, even though some of them will not be used, in such a way that the rail can have a universal and unique character in that it can be used indistinctly for window regulators of manual operation, window regulators of motorised operation and even dual rail window regulators.

Also, by incorporating directly a great part of the elements which, in the current systems have to be mounted afterwards, the number of necessary assembly operations, the associated risks and the final cost of the window regulator system are diminished.

Moreover, through being obtained by injection, it is possible for the rail to have a curvature which allows the carriage (14) to follow the movement of the window glass exactly, even though the latter has a very complex shape, the assembly of the rail on the door of the vehicle being simplified in this way.

Moreover the versatility of the injection process allows different configurations to be used of the section of the slipway on which the carriage is mounted and runs. Thus it is possible to choose from a configuration which guides the carriage in a precise fashion to a configuration which allows the carriage a certain degree of freedom according to that required to adapt to the movements required by the window glass, as a function of the configuration of the actual window glass and of the vehicle.

The invention claimed is:

1. A light-weight window regulator for a vehicle, the window regulator being operated by a cable and having a slide rail for a carriage which transports a window glass, the slide rail comprising the following elements:

fasteners for securing the window regulator to a door of the vehicle, a support and anchoring elements for a drive motor, coupling elements for a Bowden system for tensioning the cable, a housing for a cable-winding drum, sliding or diverting elements for the cable, and a series of holes adjacent to an area of the slide rail contacted by the cable, the series of holes allowing coupling of at least one clip which increases a resistance to friction of the cable in the contact area, the at least one clip having one or more pins rapid engagement in respective ones of the series of holes, wherein the slide rail, the fasteners, the drive motor support and anchoring elements, the coupling elements, the housing, and the sliding or diverting elements are a single integrated piece obtained by injection moulding a light-weight metallic alloy, wherein the slide rail has a curvature to correctly follow a movement of the window glass, and wherein the slide rail can be used with at least one selected from the group consisting of a manual window regulator, electric window regulator, and dual rail window regulator.

2. The light-weight window regulator for the vehicle, according to claim 1, wherein the slide rail further comprises a slippery external layer, produced by a de-moulding agent employed to improve extraction of the slide rail from a mould, the slippery external layer reducing friction between the slide rail and the cable in the contact area and avoiding a need to use reinforcing elements in the contact area.

3. The light-weight window regulator for the vehicle, according to claim 2, wherein the de-moulding agent is constituted by vegetable or animal waxes and Teflon.

4. The light-weight window regulator for the vehicle, according to any of claim 3, wherein the slide rail is obtained by injection of an aluminum or magnesium alloy.

* * * * *